US012256831B2

(12) United States Patent
Andersson et al.

(10) Patent No.: US 12,256,831 B2
(45) Date of Patent: Mar. 25, 2025

(54) TABLE SLIDING SYSTEM

(71) Applicant: Inter IKEA Systems B.V., Delft (NL)

(72) Inventors: Benny Andersson, Älmhult (SE); Markus Lindgren, Älmhult (SE)

(73) Assignee: Inter IKEA Systems B.V., Delft (NL)

( * ) Notice: Subject to any disclaimer, the term of this patent is extended or adjusted under 35 U.S.C. 154(b) by 247 days.

(21) Appl. No.: 17/441,953

(22) PCT Filed: Apr. 9, 2020

(86) PCT No.: PCT/SE2020/050374
§ 371 (c)(1),
(2) Date: Sep. 22, 2021

(87) PCT Pub. No.: WO2020/209784
PCT Pub. Date: Oct. 15, 2020

(65) Prior Publication Data

US 2022/0183459 A1 Jun. 16, 2022

(30) Foreign Application Priority Data

Apr. 10, 2019 (SE) ..... 1950449-7

(51) Int. Cl.
*A47B 1/10* (2006.01)

(52) U.S. Cl.
CPC ..... *A47B 1/10* (2013.01)

(58) Field of Classification Search
CPC ..... A47B 1/02; A47B 1/03; A47B 2001/025; A47B 2001/105
USPC ..... 108/83, 87, 86, 85, 84
See application file for complete search history.

(56) References Cited

U.S. PATENT DOCUMENTS 1,040,028 A * 10/1912 Schultz ..... A47B 1/08 108/83
1,210,381 A * 12/1916 Moore ..... A47B 1/03 108/84
1,302,420 A * 4/1919 Nuholm ..... 108/67
1,621,083 A * 3/1927 Rassnick ..... A47B 1/08 108/86
1,766,694 A * 6/1930 Siskin ..... A47B 1/02 108/67

(Continued)

FOREIGN PATENT DOCUMENTS

CN 2544588 Y 4/2003
CN 2843182 Y 12/2006

(Continued)

OTHER PUBLICATIONS

Office Action dated Apr. 27, 2023, in the corresponding Chinese application, 202080027405.8 (22 pages with English Translation).

(Continued)

*Primary Examiner* — Jose V Chen
(74) *Attorney, Agent, or Firm* — Merchant & Gould P.C.

(57) ABSTRACT

A table sliding system comprising: a table surface (110) and a frame (120), wherein the table surface (110) and the frame (120) together form a sliding system (100) comprising a sliding surface (140) and at least one sliding member (150); wherein said at least one sliding member (150) is arranged to be movable along said sliding surface (140), to provide a relative movement between said table surface (110) and said frame (120).

23 Claims, 13 Drawing Sheets

(56) References Cited

U.S. PATENT DOCUMENTS 1,887,266 A * 11/1932 Karlson ..... A47B 1/02 108/85
1,915,346 A * 6/1933 Wurm ..... A47B 1/03 108/85
1,937,251 A * 11/1933 Hassel ..... A47B 1/02 108/85
2,102,449 A * 12/1937 Zimmerman ..... A47B 25/00 108/63
2,140,073 A * 12/1938 Czubinski ..... A47B 1/04 108/77
2,631,075 A * 3/1953 De Gaal ..... A47B 1/08 108/86
3,033,629 A * 5/1962 Riendeau ..... A47B 1/08 108/85
3,428,369 A * 2/1969 Kowack ..... A47B 1/10 24/135 R
4,553,485 A * 11/1985 Lee ..... A47B 1/08 108/86
4,794,869 A * 1/1989 Chiu ..... A47B 1/02 108/86
5,735,220 A * 4/1998 Wang ..... A47B 1/10 108/87
5,799,571 A * 9/1998 Lee ..... A47B 1/02 100/86
5,806,437 A * 9/1998 Huang ..... A47B 1/02 108/86
5,927,212 A * 7/1999 Huang ..... A47B 1/02 108/86
2005/0034639 A1* 2/2005 Li ..... A47B 1/02 108/83
2007/0012226 A1* 1/2007 Chen ..... A47B 1/03 108/86
2013/0047898 A1* 2/2013 Lee ..... A47B 1/03 108/86
2015/0245716 A1* 9/2015 Hwang ..... A47B 1/02 297/284.3

FOREIGN PATENT DOCUMENTS

| | | | |
|---|---|---|---|
| CN | 101878993 | A | 11/2010 |
| CN | 102150995 | A | 8/2011 |
| CN | 203735687 | U | 7/2014 |
| CN | 104026872 | A | 9/2014 |
| CN | 205018523 | U | 2/2016 |
| CN | 108903255 | A | 11/2018 |
| CN | 208491182 | U | 2/2019 |
| ES | 1067906 | U | 7/2008 |
| KR | 101731192 | B1 | 4/2017 |
| WO | 2017/042203 | A1 | 3/2017 |

OTHER PUBLICATIONS

International Search Report for International Application No. PCT/SE2020/050374 mailed Jun. 26, 2020 (5 pages).
Written Opinion for International Application No. PCT/SE2020/050374 mailed Jun. 26, 2020 (7 pages).
Laneberg, AA-2140104.1, Datasheet [online], IKEA, Dec. 4, 2018, retrieved from <https://www.ikea.com/se/sv/assembly_instructions/laneberg-utdragbart-bord_AA-2140104-1_pub.pdf>.

* cited by examiner

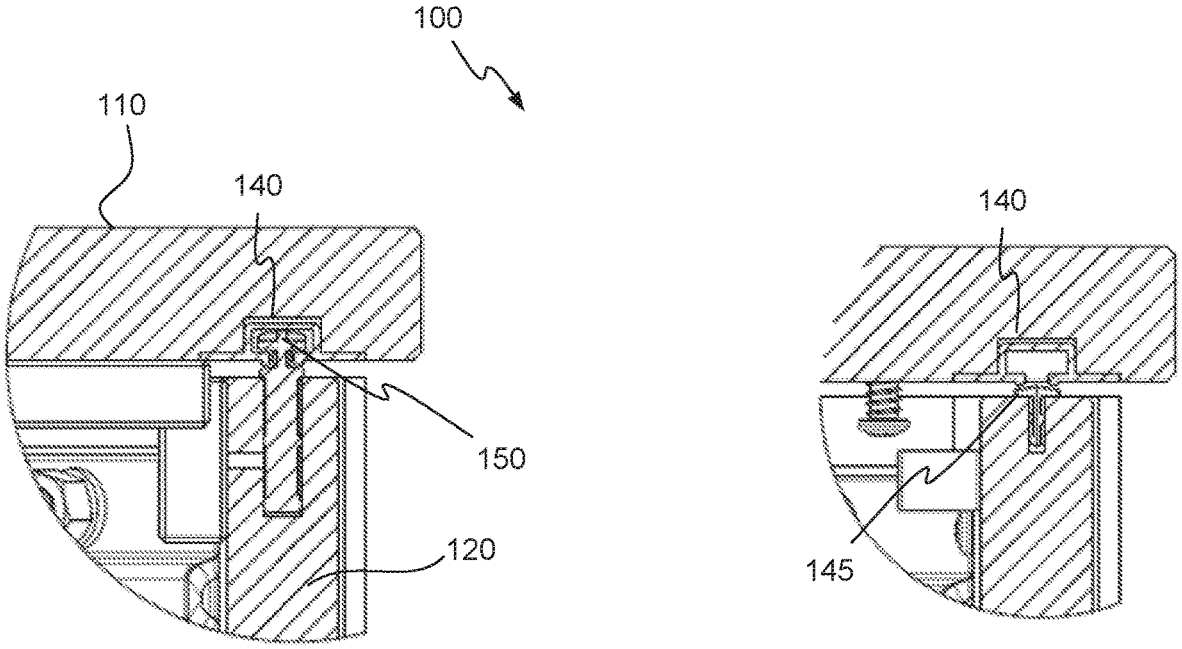
Figs. 5a-b

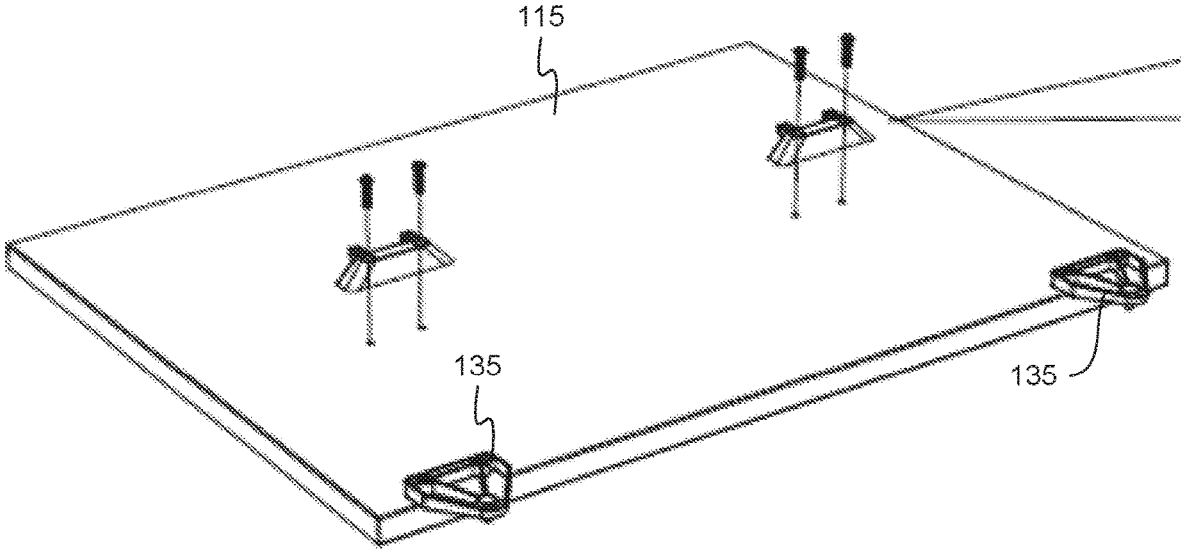
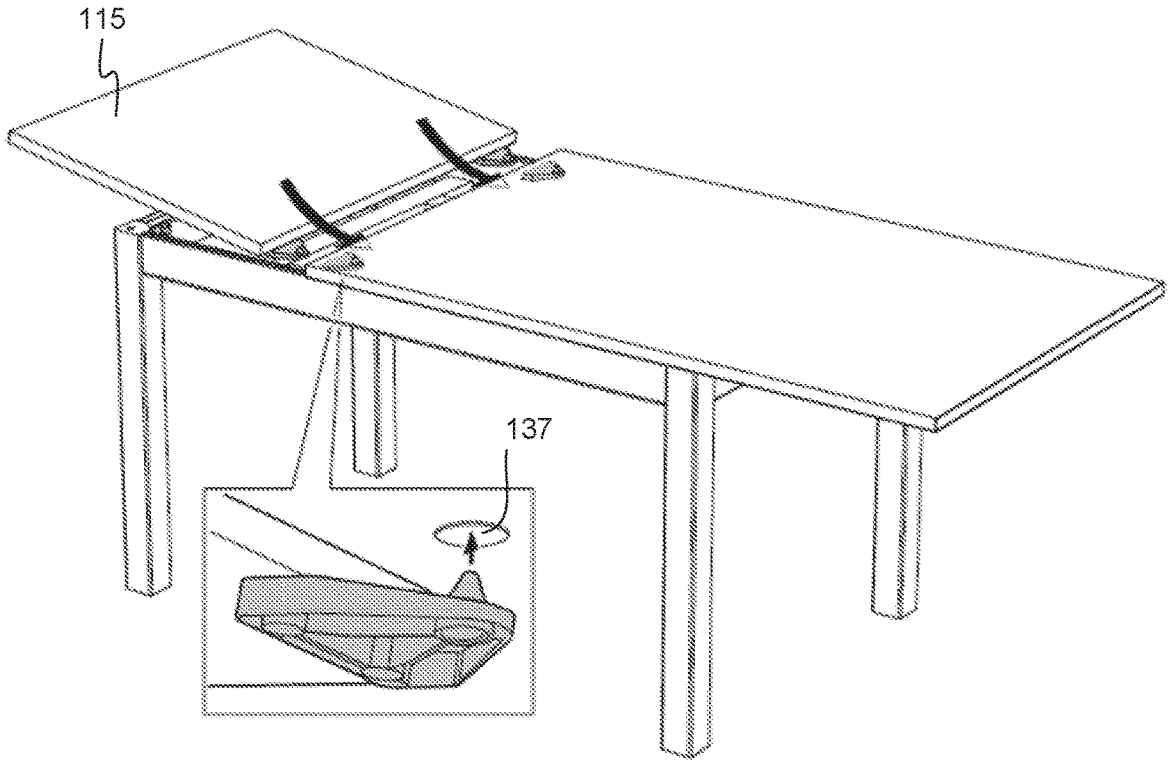
Figs. 6a-b

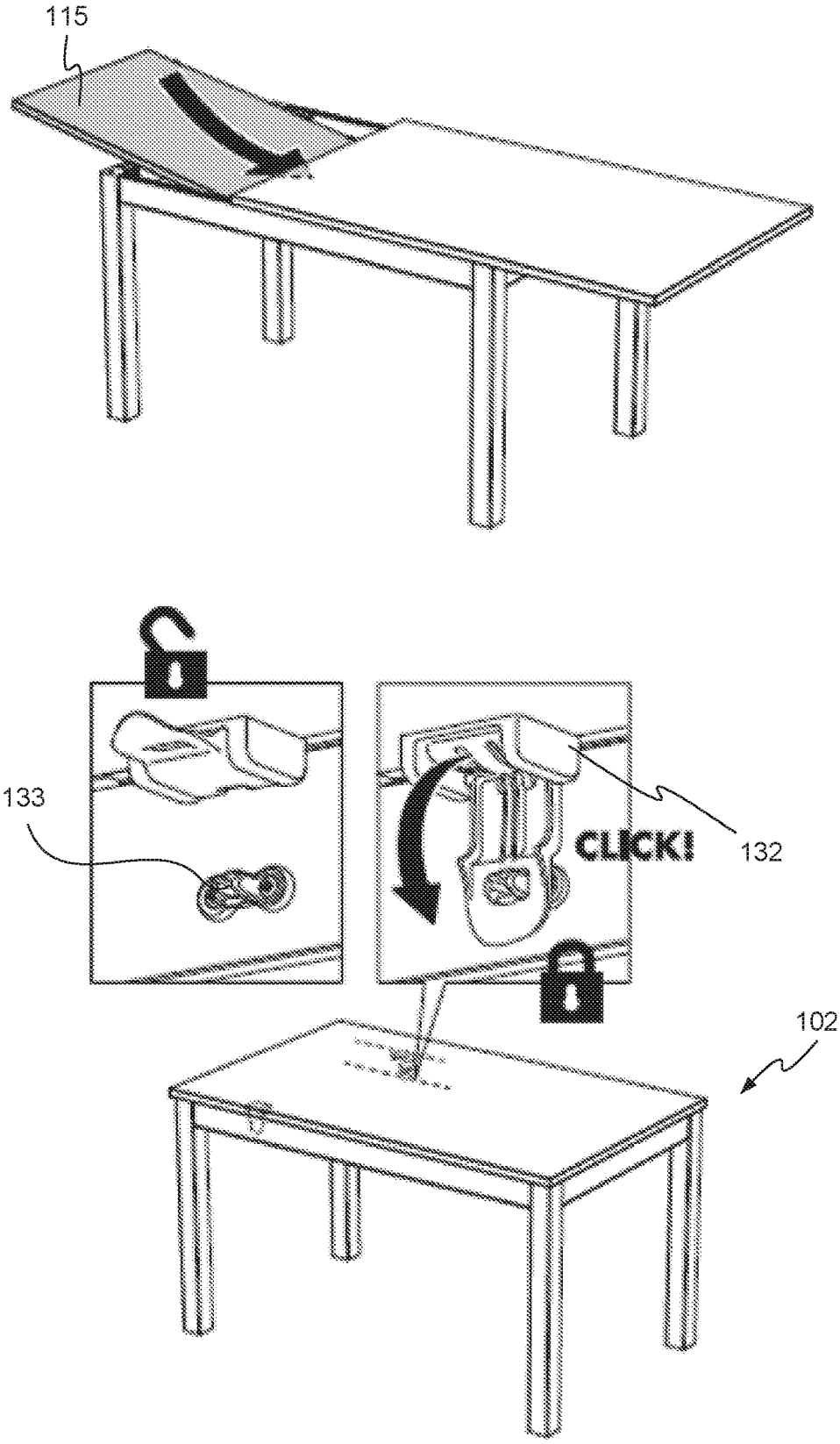
Figs. 7a-b

TABLE SLIDING SYSTEM

This application is a National Stage Application of PCT/SE2020/050374, filed 9 Apr. 2020, which claims benefit of Serial No. 1950449-7, filed 10 Apr. 2019 in Sweden, and which applications are incorporated herein by reference. To the extent appropriate, a claim of priority is made to each of the above disclosed applications.

TECHNICAL FIELD

The present invention relates to a table sliding system. More particularly the present invention relates to an extendable table sliding system forming part of an extendable table, as well as an extendable table having such a sliding system.

BACKGROUND

Extendable tables have existed for a long time and various extension techniques have been suggested in order to provide for a robust, yet easily maneuverable, solution. For example, it is common to pivotally connect the longitudinal edges of the table surface to a main central portion. A moveable frame member, e.g. a bar pivoting in a horizontal plane or a bar sliding in the horizontal plane, can be positioned to support the foldable edges of the table surface for extending the table. When a more compact table is desired, the longitudinal edges of the table surface can be lifted slightly upwards in order to allow for retraction of the moveable frame member. When the edges of the table surface are released downwards, they will pivot fully downwards to rest in a position where they extend in a vertical direction downwards.

Another known example of extendable tables is based on an insert. The table surface is divided into two parts being pushed towards each other to form a single table surface. Each part of the table surface is supported by a respective underlying extendable frame, such that each part of the table surface is fixed to an associated frame part. This extendable frame is a sliding structure so that when the table is to be extended the two parts of the table surface can be pulled away from each other, thereby also extending the underlying frame by separating the frame parts, and leaving a gap in between the separated table surfaces. In this gap, an insert can be positioned, while also the insert is supported by the underlying extendable frame. The insert forms an intermediate table surface portion, being aligned with the two original table surface parts so to form a continuous, and extended, table surface.

The first example of prior art is suffering from the obvious drawback of that when the table is in its compacted position the areas between the legs are covered by the pivoted edges of the table surface. This means that a person cannot sit comfortably at the edge as his or hers legs cannot be positioned under the table surface.

In the other example mentioned above, the extendable frame is normally based on wood members sliding relative each other. Although a simple and cost effective solution is provided, the friction between the wooden parts is often causing a severe problem for a person trying to pull the two table surface parts away from each other. The problem may be even worse when the two table surface parts are pushed against each other. In order to solve this problem there has been suggested low friction solutions requiring moveable sliding members, such as guide rollers etc., but these types of solutions suffer from a high cost.

The Applicant has previously presented a solution to this problem in WO 2017/042203 A1, which describes a novel sliding system that allows for low friction in a cost efficient manner. This sliding system is however limited to specific applications using a specific type of extendable table.

In view of the problems mentioned there is still a need for an improved extendable table which allows for a simple and cost effective structure and manufacturing, while still allowing for easy operation and maneuver by a person using the table.

SUMMARY

According to a first aspect of the invention, the above and other objects of the invention are achieved, in full or in part, by a table sliding system comprising: a table surface, forming a table top, and a frame, wherein the table surface and the frame together form a sliding system comprising a sliding surface arranged on one of the table surface and the frame, and at least one sliding member arranged on the other one of the table surface and the frame; wherein said at least one sliding member is arranged to be movable along said sliding surface, to provide a relative movement between said table surface and said frame.

It should be noted that in the context of this application, the term "extendable" does not necessarily mean to allow for an extension of the table in its length or width direction, but should be interpreted broadly to also cover tables having at least one table surface being moveable from one position, in which it is positioned in a first (and planar) manner relative the frame, to another position, in which it is positioned in a second (and planar) manner relative the frame. Hence, tables having a large frame and a table surface only partially covering the frame, but being moveable to different positions relative the frame, also fall under the term "extendable".

The table surface may comprise said sliding surface and said frame may comprise said at least one sliding member, or the table surface may comprise said sliding member and said frame may comprise said sliding surface. Preferably, the table surface is forming the entire table surface of the extendable table in a first, shorter, setting of the extendable table. This is advantageous in that this allows for simpler construction and a more even distribution of weight, which in turn improves slideability.

The frame may be arranged to be stationary during said relative movement. This is advantageous in that the frame is usually cumbersome to move.

The at least one sliding member may be arranged to be stationary during said relative movement. This is advantageous in that it allows for a more even distribution of weight, which in turn improves slideability.

The at least one sliding member may extend horizontally, and vertically towards said sliding surface. This is advantageous in that is reduces the impact of gravity on the friction.

The sliding surface may comprise at least one opening arranged to receive said at least one sliding member. This is advantageous in that it allows for simple assembly and disassembly without accidental disassembly.

The sliding system may be further arranged to only allow said relative movement along a single axis. This is advantageous in that it reduces the risk of accidental disassembly and allows for a sliding system that is more robust and easier to use.

The sliding system may further comprise a retracted position and an extended position, wherein said relative movement moves said sliding system between said positions. This also means that the sliding system is configured to be maneuverable between the retracted position and the extended position. This is advantageous in that each defined position (i.e. the retracted position and the extended position) may be reinforced to be more stable.

The sliding system may be further arranged to only allow said relative movement from said retracted position to said extended position in one direction. This is advantageous in that it reduces the risk of accidental disassembly and allows for a sliding system that is more robust and easier to use.

The sliding system may comprise a plurality of sliding members, and the sliding members may be arranged asymmetrically in relation to a mid-point of the table sliding system, along said one direction. This is advantageous in that it reduces the risk of wrong assembly and allows for a sliding system that is more robust and easier to use.

The table surface and/or said frame may comprise interlocking means to keep said system in one of said positions (i.e. the retracted position and/or the extended position). This is advantageous in that it prevents accidental sliding of the sliding system.

The frame may further comprise a secondary sliding surface. The secondary sliding surface is advantageous in that it allows for an even distribution of height and weight. Further, the secondary sliding surface may facilitate positioning of the table surface, and in particular if the table surface is a secondary table surface to complement a primary table surface. The secondary sliding surface also provides for an extra sliding surface for the primary table surface, which is particularly advantageous if the table surface is moved while being loaded with weight.

The sliding system may further comprise a secondary table surface configured to be arranged in parallel to said primary table surface. The secondary table surface is advantageous in that it extends the surface area of the table.

The secondary table surface may be arranged to rest on said secondary sliding surface. This is advantageous in that the secondary table surface will then easily achieve the same height as the primary table surface, and the secondary sliding surface ensures very smooth and low friction movement of the secondary table surface, for example when mounting the secondary table surface to the frame.

The primary table surface and said secondary table surface may comprise interlocking means to align said table surfaces with each other. This is advantageous in that it allows for simple and fast alignment.

The secondary table surface may be arranged to be stored within said frame. This is advantageous in that it is simple and space efficient to store it within the table.

The secondary table surface may be arranged to only be accessible from said storage when said system is in said extended position. This is advantageous in that the storage is then hidden in the retracted position.

The frame may be non-extendable. This is advantageous in that it may be cumbersome to extend the frame. A user usually only cares about extending the table surface, while extending the frame may be seen as a downside as it may reduce the leg space for persons sitting at the table.

The sliding surface may be coated with a lacquer comprising a resin, wherein said lacquer in turn is at least partly coated with a lipophilic composition coating to provide a slide layer with a lowered friction. This is advantageous in that it further reduces friction.

The sliding surface may be formed on at least one surface of a C-shaped groove in either said table surface or said frame. The C-shape is advantageous in that it guides the sliding member well.

The C-shaped groove can have an exterior side being in contact, preferably sliding contact, with the secondary sliding surface.

According to a second aspect of the invention, an extendable table comprising at least one sliding system according to the previous aspect is provided.

Other objectives, features and advantages of the present invention will appear from the following detailed disclosure, from the attached claims, as well as from the drawings. It is noted that the invention relates to all possible combinations of features.

It should be emphasized that the term "comprises/comprising" when used in this specification is taken to specify the presence of stated features, integers, steps, or components, but does not preclude the presence or addition of one or more other features, integers, steps, components, or groups thereof. All terms used in the claims are to be interpreted according to their ordinary meaning in the technical field, unless explicitly defined otherwise herein. All references to "a/an/the [element, device, component, means, step, etc.]" are to be interpreted openly as referring to at least one instance of the element, device, component, means, step, etc., unless explicitly stated otherwise.

BRIEF DESCRIPTION OF THE DRAWINGS

By way of example, embodiments of the present invention will now be described with reference to the accompanying drawings, in which:

FIGS. 5*a-b* show an extendable table sliding system according to an embodiment;

FIGS. 6*a-b* show a secondary table surface according to an embodiment;

FIGS. 7*a-b* show a secondary table surface storage according to an embodiment;

DETAILED DESCRIPTION

Figure 1A:
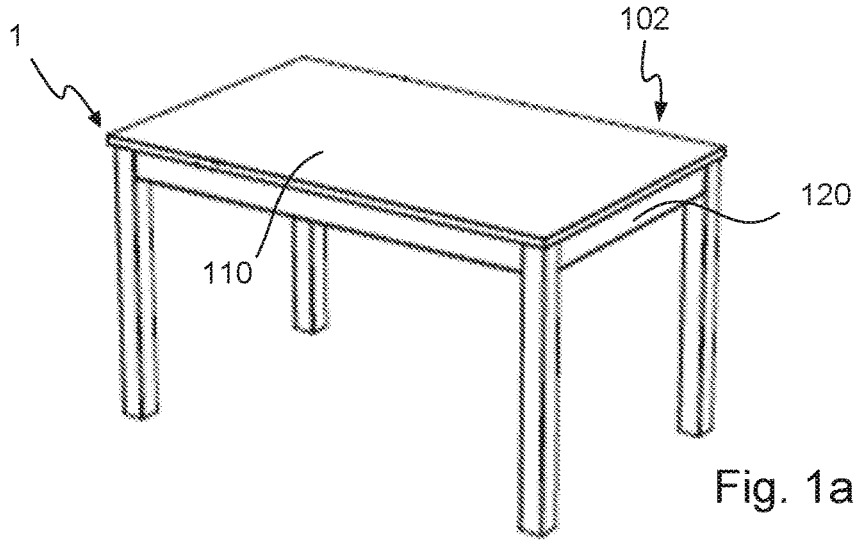
FIG. 1*a* shows an extendable table in a retracted position according to an embodiment.

Embodiments of the invention will now be described with reference to the accompanying drawings. The invention may, however, be embodied in many different forms and should not be construed as limited to the embodiments set forth herein; rather, these embodiments are provided so that this disclosure will be thorough and complete, and will fully convey the scope of the invention to those skilled in the art. The terminology used in the detailed description of the particular embodiments illustrated in the accompanying drawings is not intended to be limiting of the invention. In the drawings, like numbers refer to like elements.

Figure 1B:
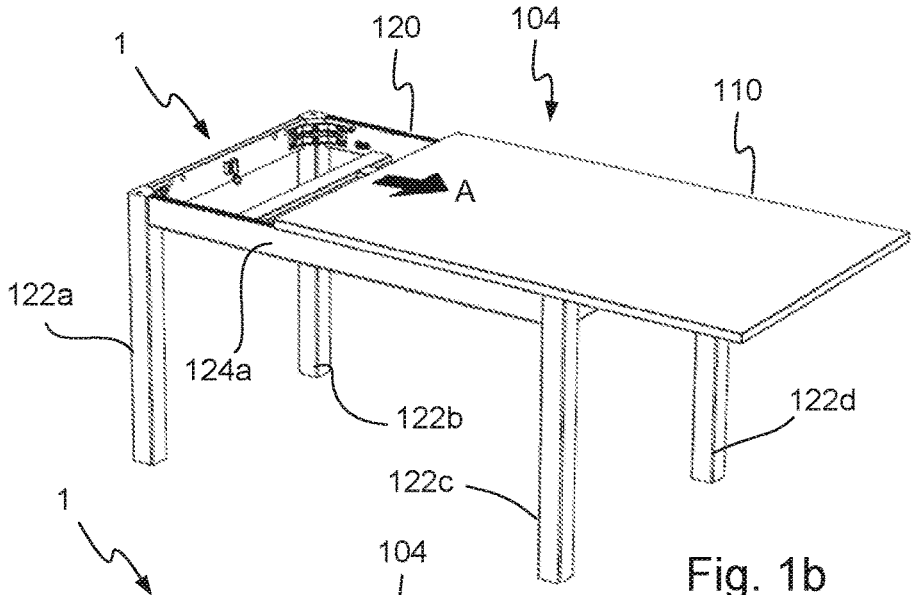
FIG. 1*b* shows an extendable table in an extended position according to an embodiment, having only one table surface.
Figure 1C:
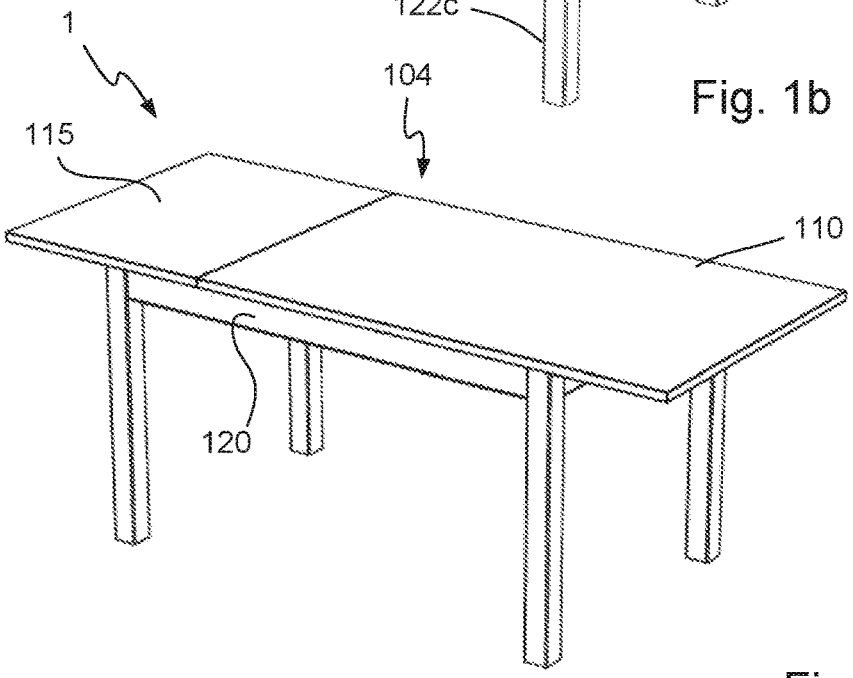
FIG. 1*c* shows an extendable table in an extended position according to an embodiment, having two table surfaces.

Starting in FIGS. 1*a-c*, an extendable table 1 is shown in different positions. Starting in FIG. 1*a*, the extendable table is in a retracted position 102, wherein only one primary table surface 110, forming a table top, is arranged onto a frame 120. In FIG. 1*b*, the table surface 110 is pulled relative the frame 110, thereby showing the extendable table 1 in an extended position 104. In FIG. 1*c*, the extendable table 1 is provided with a secondary table surface 115, thereby increasing the length of the table 1.

The table surface 110 and the frame 120 together form a sliding system 100 comprising a sliding surface 140 and at least one sliding member 150, which will be discussed further in relation to FIGS. 5*a-b*. The at least one sliding member 150 is arranged to be movable along the sliding surface 140, to provide a relative movement between the table surface 110 and the frame 120.

The table surface 110 is any substantially flat surface suitable as a table surface, which may be made from wood, HDF, glass, metal, rock or plastic. Preferably, the table surface 110 has a larger surface area than the dimensions of the frame 120.

The frame 120 comprises four legs 122*a-d* defining the dimensions of the frame 120; the area covered by the frame 120 is preferably smaller than the table surface 110. In other embodiments, the frame 120 may comprise any number of legs, including zero and one. The frame 120 is preferably made from a hard, solid material such as wood, HDF, glass, metal, rock or plastic.

The frame 120 is arranged to be stationary during the relative movement of the sliding system 100. This is achieved because the leg(s) 122*a-d* of the frame 120 are arranged to be in contact with a stationary floor. This is beneficial over prior art systems, as most floors are stationary and it is therefore intuitive and practical to keep the frame 120 stationary as well during extension of the table 1. However, as will be explained with respect to FIGS. 12*a-c*, the frame 120 may in some embodiments be extendable.

The table surface 110 and the frame 120 are slideable relative to each other to achieve a movement between a retracted position 102 and an extended position 104. In the extended position 104, the table surface 110 is arranged off-center the frame 120 and the table surface 110 does not fully cover the frame 120 as shown in FIG. 1*b*. In the retracted position 102, the table surface 110 fully covers the frame 120.

The sliding system 100 is further arranged to only allow the relative movement along a single axis A (see FIG. 1*b*). This axis A is preferably parallel to the longest edge 124*a* of the table 1. The sliding system 100 may further be arranged to only allow movement from the retracted position 102 to the extended position 104 in one direction along the axis A, which provides a dedicated direction of extension.

Figure 2:
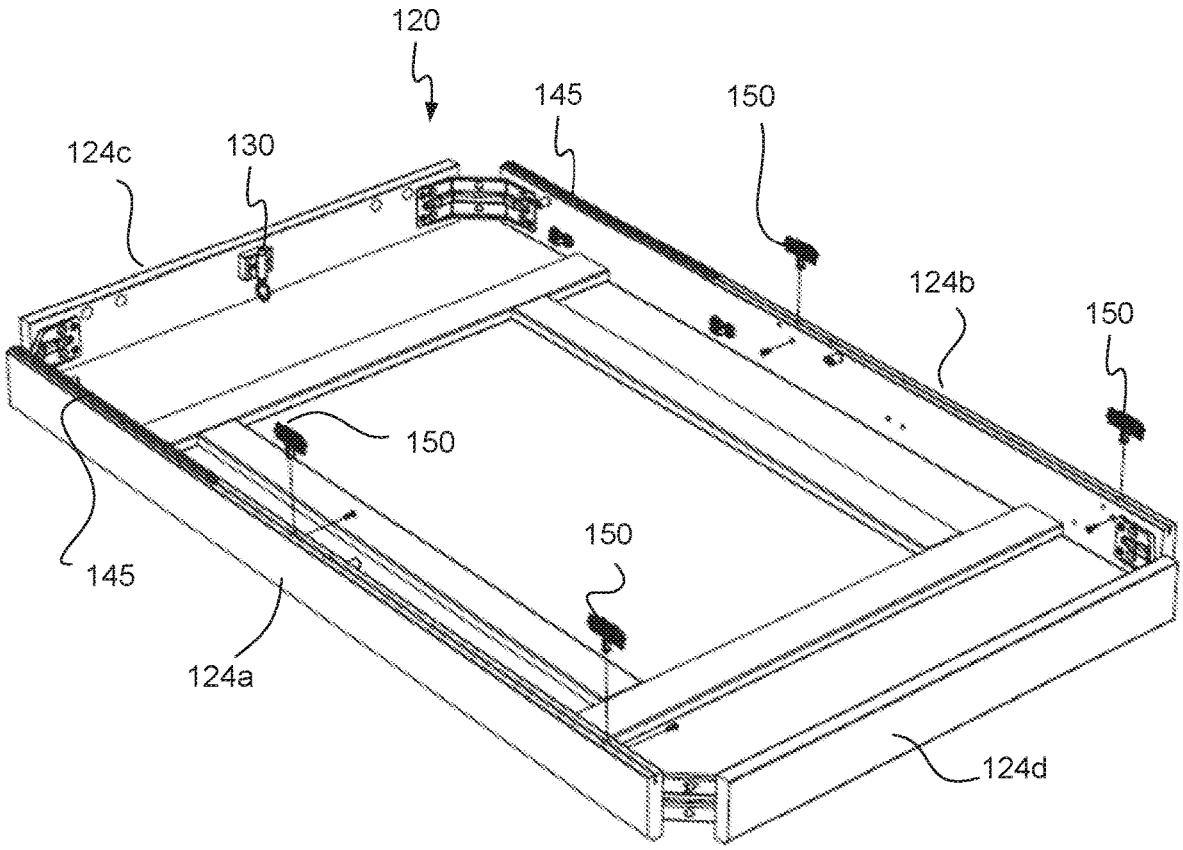
FIG. 2 shows a frame according to an embodiment.

FIG. 2 shows the frame 120 in further detail. In FIG. 2 the legs 122*a-d* are not shown, whereby the frame 120 is formed by four edges 124*a-d* arranged in a rectangular manner; two long edges 124*a-b* are perpendicularly connected to two shorter edges 124*c-d*. In some embodiments, the lengths of the edges 124*a-d* may be equal.

The frame 120 comprises at least one sliding member 150. The four sliding members 150 of the embodiment shown are arranged asymmetrically along the axis A of FIG. 1, two sliding members 150 on each one of two opposite long edges 124*a-b*. In this embodiment, movement from the retracted position 102 to the extended position 104 is only allowed in one direction, so symmetry is not needed. Rather, if the sliding members 150 were distributed symmetrically then two sliding members 150 would prevent correct positioning of the secondary table surface 115 (see FIGS. 1*a-c*).

At the end of the frame 120 where sliding members 150 would otherwise be arranged to achieve symmetry, a secondary sliding surface 145 is arranged. The secondary sliding surface 145 may be any surface suitable for sliding and not necessarily the same surface as the sliding surface 140 (as will be described below). In this embodiment, the secondary sliding surface 145 is further arranged to equalize the weight distribution of the table surface 110 along the frame 120 to facilitate smooth and easy sliding.

In accordance with a preferred embodiment, the secondary sliding surface 145 may be made of plastic, e.g. of the same material as the sliding members 150.

The secondary sliding surface 145 may alternatively be arranged to engage with at least one sliding member 150 of the table surface 110. This may be used to provide an alternative sliding direction or mechanism.

The frame 120 further comprises interlocking means 130 to keep the sliding system 100 in the retracted position 102. The interlocking means 130 is e.g. a spring-loaded pin with a mating receiving hole 132 (see FIG. 3) in the table surface 110.

Figure 3:
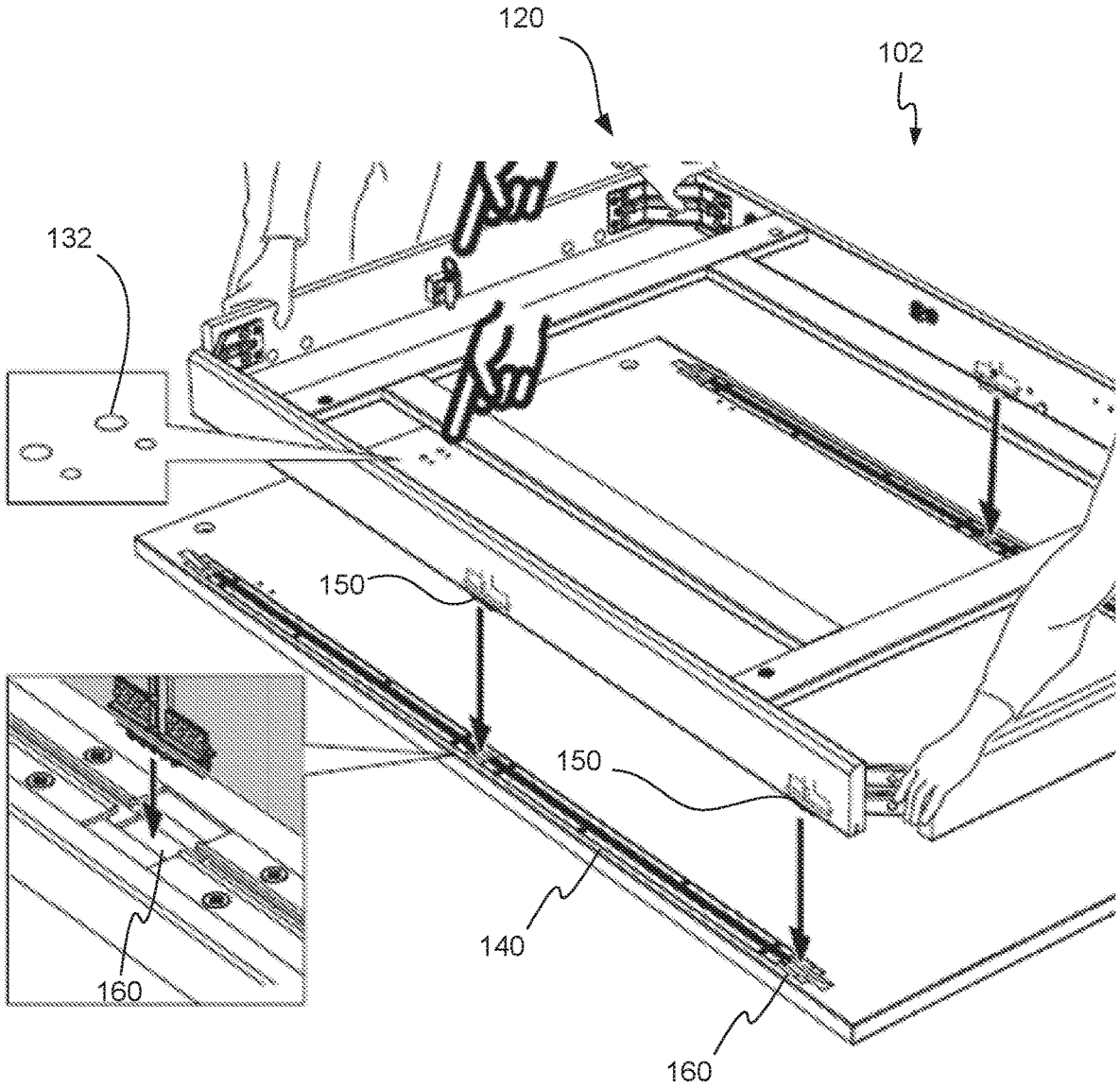
FIG. 3 shows a frame and a table surface according to an embodiment.

FIG. 3 shows a frame 120 and a table surface 110 during assembly into the retracted position 102. The table surface 110 comprises the sliding surface 140. The sliding surface 140 may be partially embedded into the table surface 110 and may be surrounded by a material being different from the material of the table surface 110 or the sliding surface 140. The sliding surface 140 is preferably formed on at least one surface of a C-shaped groove.

The sliding surface 140 comprises at least one opening 160 arranged to receive the at least one sliding member 150. There are preferably as many openings 160 as there are sliding members 150 and they are preferably aligned with each other. Once the sliding member(s) 150 are received by the opening(s) 160, they are only removable from the sliding surface 140 using the same opening(s) 160. The sliding surface 140 restricts the movement of the sliding members (s) 150 at least vertically beyond the opening(s) 160, but preferably also in the lateral direction.

Alternatively to vertical openings 160, a horizontal opening 160 integrated into an end of the sliding surface 140 is possible. Any opening 160 may further be closed after assembly, in order to prevent accidental disassembly. Alternatively, once the sliding surface 140 has been moved to a suitable position a pin or similar may be mounted to prevent free sliding of the sliding surface 140 relative to the sliding members 150, thereby preventing the sliding members 150 from coming into alignment with the openings 160.

The assembly shown is performed in a vertical direction (wherein the frame 120 is moved vertically downwards onto the table surface 110), however different ways are possible, such as assembly in a horizontal direction. The sliding system 100 interacts vertically in the embodiment shown, however this is unrelated to the assembly direction and further embodiments of the sliding system 100 interaction will be discussed further with relation to FIGS. 5*a-b*.

Figure 4:
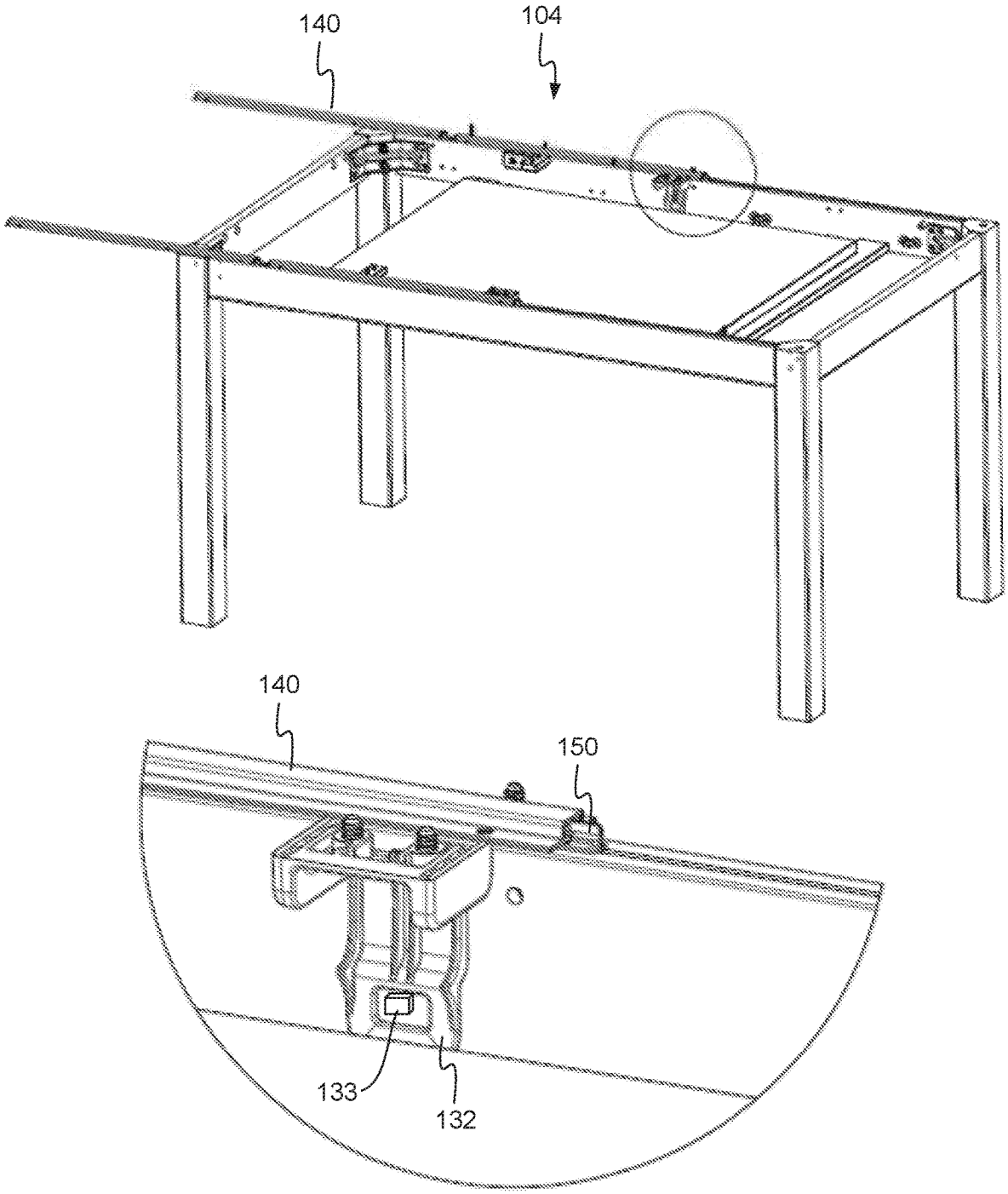
FIG. 4 shows an extendable table in an extended position without a table surface according to an embodiment.

FIG. 4 shows an extendable table 1 in an extended position 104 wherein the table surface 110 is not shown for illustrative purposes, but with the sliding surfaces 140 of the table surface 110 still shown. The two sliding surfaces 140 are extended away from the frame 120 and guided by the sliding members 150 of the frame 120. The sliding surfaces 140 extend the available surface area that can be supported by the frame 120 without extending the frame 120 itself, allowing a larger table surface 110 to be supported, thereby extending the table 1.

FIG. 4 further shows interlocking means 132 mounted on the lower side of the not shown table surface 110 and arranged to keep the sliding system 100 in the extended position 104. The interlocking means 132 may e.g. be one or more clasps arranged on the table surface 110, and having an open and a closed arrangement. The open arrangement shown in FIG. 4 is arranged to interact with a protrusion 133 of the frame 120 to hold the sliding system 100 in place.

FIG. 5*a* shows, in cross-section, an extendable table sliding system 100 with a sliding surface 140 and a sliding member 150. The figures show the table surface 110 comprising the sliding surface 140 and the frame 120 comprising the sliding member 150, however the reverse configuration may also be used. The sliding surface 140 and/or the sliding member 150 may be integrally formed in the table surface 110 and/or the frame 120.

The sliding member 150 extends vertically towards the sliding surface 140, however other arrangements are possible such as sliding members 150 extending horizontally away from the edges of the table 1.

The sliding member 150 is arranged to be stationary during the movement of the sliding surface 140. The sliding surface 140 is arranged to be movable by a user due to a lowered friction between the sliding surface 140 and the sliding member 150.

The sliding member 150 primarily functions to reduce friction between the sliding surface 140 and its interface to the frame 120. The sliding member 150 is preferably made from a material with low friction, such as metal or plastic, and preferably comprises protrusions or blades that reduce the contact area of the sliding member 150.

The contact area of each individual contact point of the sliding member 150 is preferably less than 3 $mm^2$, more preferably less than 1.5 $mm^2$, and most preferably less than 0.75 $mm^2$ and the contact pressure in the at least one contact point is at least 4 $N/mm^2$, preferably at least 8 $N/mm^2$, and more preferably at least 12 $N/mm^2$, and wherein preferably the contact pressure is lower than the strain at yield of the material of the sliding member 150 at the contact point.

The sliding member 150 is preferably made from a plastic comprising a polymer with polar groups, more preferably the polar groups are selected from the group consisting of hydroxyl groups, carboxylic acid groups, amide groups, halide groups, sulfide groups, cyano groups (nitrile groups), carbamate groups, aldehyde groups, and/or ketone groups.

The sliding member 150 may be made of a plastic comprising a polymer selected from the group of polymers consisting of polyoxymethylenes (POM), polyesters (e.g. thermoplastic polyesters, such as polyethylene terephthalate (PET), polytrimethylene terephthalate (PTT), polybutylene terephthalate (PBT), and poly lactic acid (PLA), as well as bio-based thermoplastic polyesters, such as polyhydroxyalkanoates (PHA), polyhydroxybutyrate (PHB), and polyethylene furanoate (PEF)), polyamides (PA), polyvinyl chloride (PVC), polyphenylene sulfide (PPS), polyaryletherketone (PAEK; e.g. Polyether ether ketone (PEEK)), and Polytetrafluoroethylene (PTFE).

Any number of sliding surfaces 140 and sliding members 150 are possible, however there are preferably at least as many sliding members 150 as there are sliding surfaces 140. There may e.g. be one sliding surface 140 and one elongated sliding member 150 arranged in the middle of the table 1.

The sliding surface 140 may be made from a material having a Vickers hardness of at least 50 MPa, more preferably at least 100 MPa, and most preferably at least 150 MPa, such as metal or glass, preferably the material is a metal and more preferably aluminum and/or steel.

The sliding surface 140 is shown as being C-shaped, however any shape is possible including flat or a shape that changes along its length. In order to reduce the friction of the sliding surface 140, the sliding surface 140 may be coated with a lacquer comprising a resin, wherein said lacquer in turn is at least partly coated with a lipophilic composition coating to provide a slide layer with a lowered friction.

The resin of the lacquer comprises polar groups, such as hydroxyl groups, carboxylic acid groups, amide groups, cyano groups (nitrile groups), halide groups, sulfide groups, carbamate groups, aldehyde groups, and/or ketone groups. The resin may be a thermosetting resin.

The resin of the lacquer may be selected from the group consisting of: acrylic resins, acrylate resins, acrylamide resins, methacrylate resins, methyl metachrylate resins, acrylonitrile resins, styrene-acrylonitril resins, acrylonitrile styrene acrylate resins, reaction products or a mechanical mixture of alkyd resin and water-soluble melamine resin, reaction products or a mechanical mixture of a vinyl-modified unsaturated alkyd resin and a water-soluble melamine resin, and polymers and mixtures of one or several of these resins.

The lacquer may be applied by electro coating or autodeposition in a bath containing the lacquer, or by electrostatic coating with a powder lacquer. The thickness of the lacquer coated on the sliding surface 140 is 100 μm or less, preferably 75 μm or less, more preferably 50 μm or less and most preferably 15 to 40 μm.

In one embodiment, the sliding surface 140 is a rail and the sliding member 150 is a wheel arranged to roll along the rail 140. In another embodiment, the sliding member 150 is a solid block protrusion and the sliding surface 140 comprises smaller protrusions or blades that reduce the contact area of the sliding surface 140.

FIG. 5*b* shows an extendable table sliding system 100 with a sliding surface 140 and a secondary sliding surface 145. This sliding system 100 has partially replaced the sliding member 150 with a secondary sliding surface 145 during a section of the sliding surface 140. The secondary sliding surface 145 may reduce the friction between the sliding surface 140 and the frame 120, but its primary function is to carry the table surface 110 at the same height even where a sliding member 150 is not needed. This improves stability and slideability.

FIG. 6*a* shows a secondary table surface 115. The secondary table surface 115 may be bigger or smaller than the primary table surface 110 and may be configured to be arranged in parallel to the table surface 110 as seen in FIG. 6*b* to create a larger total surface area or completely replace it with a larger surface area.

The secondary table surface 115 of FIG. 6*a* comprises two locking aligning means 135. The aligning means 135 are hooks arranged to interact with mating holes 137 on the underside of the table surface 110. The aligning means 135 are used to align the secondary table surface 115 with the table surface 110 so that they lay parallel to each other and so that their edges match.

The secondary table surface 115 is arranged to rest on the secondary sliding surface 145 once in position. This is a further advantage of the secondary sliding surface 145, as this is a much simpler way for a user to achieve a correct height of the secondary table surface 115 than to rest it on sliding members 150 that may not be as simple to align or may require openings 160 in the secondary table surface 115. FIG. 7*a* shows a secondary table surface storage. In order to save space, the secondary table surface 115 is arranged to be stored within the frame 120. The secondary table surface 115 is arranged to only be accessible from the storage when the sliding system 100 is in the extended position 104, however alternatives include but are not limited to always accessible horizontally openable drawers or hooks reachable from below the table 1 to hold the secondary table surface 115.

FIG. 7*b* shows the extendable table 1 in a retracted position 102. The secondary table surface 115 is completely hidden within the frame 120 and no parts of the sliding system 100 is visible, especially because the frame 120 is completely solid and non-extendable. A user usually only cares about extending the table surface, while extending the frame 120 may be seen as a downside as it may reduce the leg space and be aesthetically displeasing. Therefore the frame 120 is arranged to be non-extendable.

FIG. 7*b* further shows the interlocking means 132, 133 that lock the sliding system 100 in the retracted position 102, which is easily unlockable by a user when a table 1 extension is requested.

In the following, other embodiments of extendable tables 1, as well as details thereof, will be described.

Figure 8A:
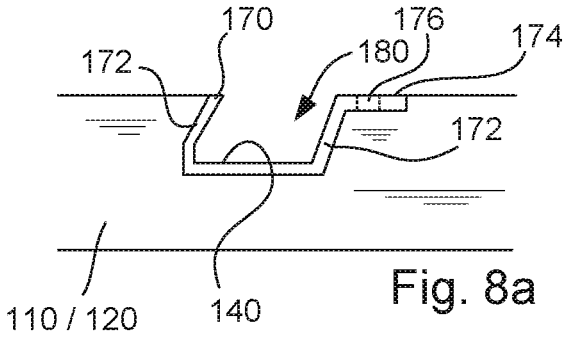
FIGS. 8*a-f* are cross-sectional views showing the sliding surface according to various embodiments.

As mentioned earlier, the sliding surface 140 can be formed on the surface of a C-shaped groove in either the table surface 110 or the frame 120. Examples of such C-shaped grooves are shown in FIGS. 8*a-f* In each one of FIGS. 8*a-f*, the C-shaped groove is provided by means of an insert 170, which may be surface treated in order to provide for a low friction sliding interface. The insert 170, which e.g. may be formed by metal, is inserted in a recess 180 in either one of the table surface 110 or the frame 120. Fitting of the insert 170 into the recess 180 may be done in one of many ways. As is shown in FIG. 8*a*, the insert 170 has a tilted appearance, meaning that the sidewalls 172 of the insert 170 are not vertical, i.e. not perpendicular to the bottom surface which forms the sliding surface 140. One sidewall 172 is extended into an upper wing 174, forming a support against the rigid structure to which it is attached, i.e. the table surface 110 or the frame 120. The upper wing 174 is preferably provided with one or more through holes 176 for allowing the insert 170 to be screwed to its associated rigid structure 110, 120.

Figure 8B:
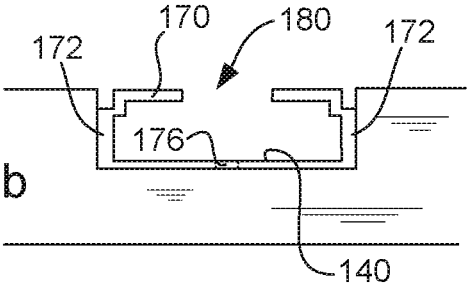

In FIG. 8*b* another embodiment of an insert 170 is shown. As the insert 170 has a straight appearance, i.e. the sidewalls 172 are extending perpendicular from the bottom surface forming the sliding surface 140, fitting of the insert 170 in the recess 180 is performed by screwing the insert 170 using screw holes 176 in the bottom surface.

Figure 8C:
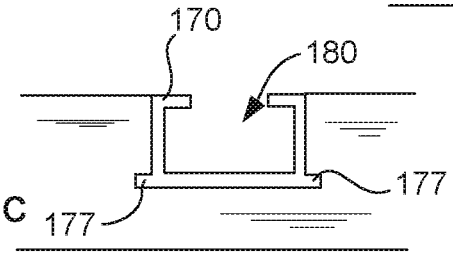

In FIG. 8*c* another embodiment of an insert 170 is shown. The insert 170 has at its bottom surface wings 177 extending laterally outwards, thereby forming an undercut profile. In this embodiment the insert 170 must be pushed into the recess 180 from the side, whereby the wings 177 prevents the insert 170 from moving relative the recess 180.

Figure 8D:
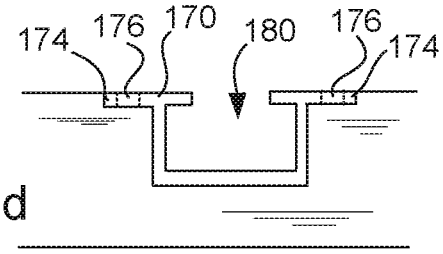

A yet further embodiment of an insert 170 is shown in FIG. 8*d*. The insert 170 is provided with wings 174 at both lateral sides, whereby through holes 176 in each wing 174 allows for secure screwing of the insert 170.

Figure 8E:
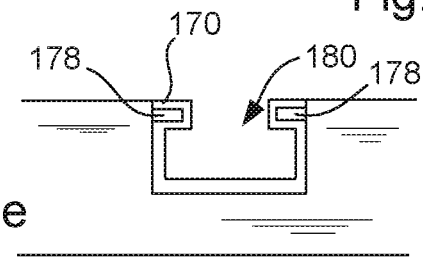

Another embodiment of an insert 170 is shown in FIG. 8*e*. For this insert, no screws are required but instead pockets 178 for glue are provided at the upper end of the insert 170. The pockets 178, which extend at least along a part of the length of the insert 170, are open towards the rigid structure having the recess 180 such that the glue will provide for a good fixation of the insert 170 in the recess 180.

Figure 8F:
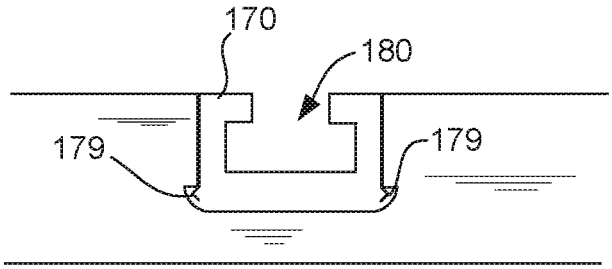

Yet another embodiment of an insert 170 is shown in FIG. 8*f*. Also this insert 170 is fixated in the recess 180 without using any screws. Instead, the insert 170 is in the shape of a folded plate material, having resilient hooks 179 at its lateral ends, which hooks 179 can be snap-locked into the recess 180.

It should be realized that different configurations of the insert 170 are possible.

Figure 9A:
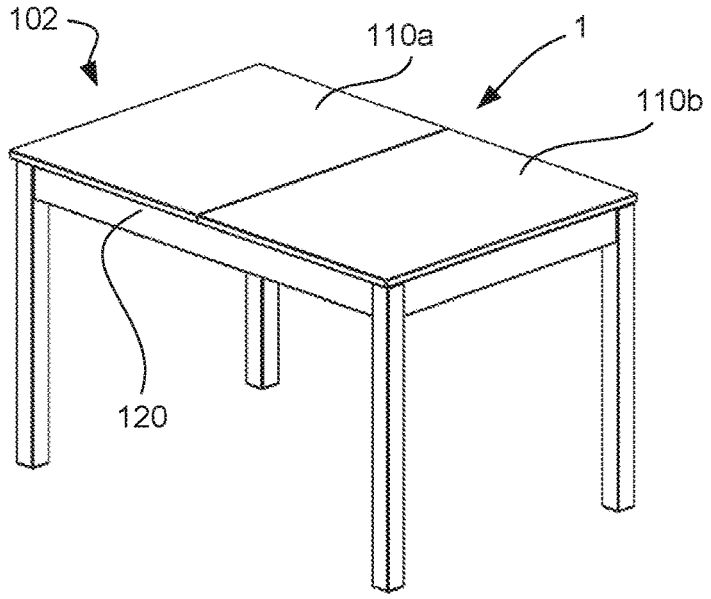
FIGS. 9*a-c* show an extendable table according to an embodiment.
Figure 9B:
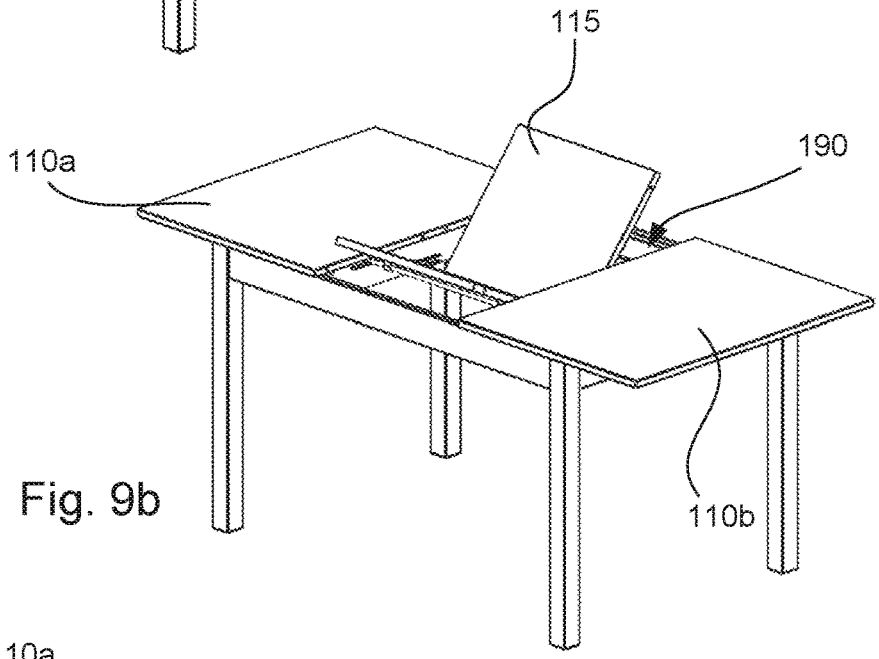
Figure 9C:
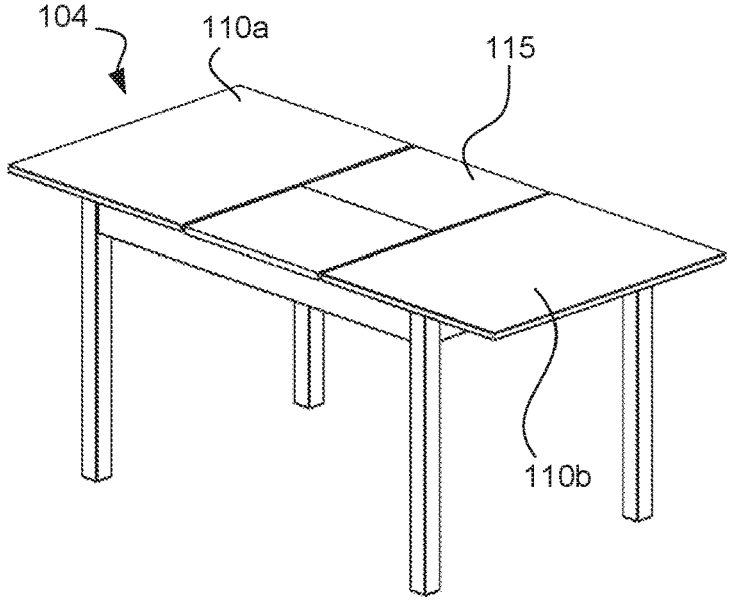

Now turning to FIGS. 9*a-c*, another embodiment of an extendable table 1 is shown. In FIG. 9*a* the table 1 is shown in a retracted position 102. Two table surfaces 110*a-b* are arranged onto a frame 120. As is shown in FIG. 9*b*, the two table surfaces 110*a-b* can be pulled away from each other, thereby opening a central gap 190, into an extended position 104 (shown in FIG. 9*c*). Each of the two table surfaces 110*a*, 110*b* may slide relative to the frame 120 according to principles similar to those described hereinbefore with reference to FIGS. 1*a*-5*b*. In the central gap 190 a secondary table surface 115 can be positioned, thereby closing the gap 190 and forming a uniform table surface together with the two table surfaces 110*a-b*. As can be seen in FIG. 9*b*, the secondary table surface 115 can be of a butterfly type, or it can be solid and planar.

Figure 10A:
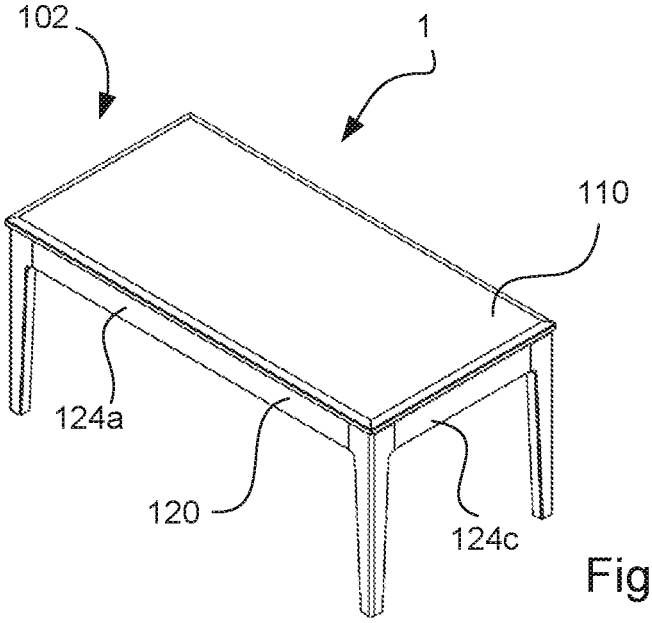
FIGS. 10*a-b* show an extendable table according to an embodiment.
Figure 10B:
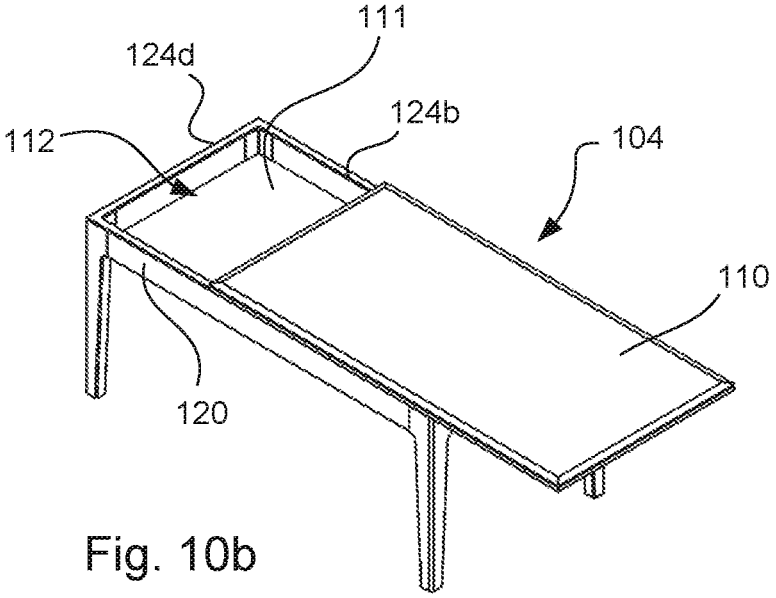

In FIGS. 10*a-b* another embodiment of an extendable table 1 is shown. A retracted position 102 of the table 1 is shown in FIG. 10*a*, while an extended position 104 of the table 1 is shown in FIG. 10*b*. As can be seen, a table surface 110 is movable relative the frame 120 in a manner similar to what is shown in FIG. 1*b*. However, in this embodiment the frame 120 is provided with a bottom surface 111 such that a cavity 112 is formed between the bottom surface 111 and the edges 124*a-d* of the frame 120. This cavity 112 is preferably used to store various articles. The cavity 112 is accessible by moving the table surface 110 relative the frame 120, and closable by a return movement of the table surface 110. Hence, this table 1 need not have the capability of being extended to a longer length, but to provide access to a storage space under the table surface 110.

Figure 11A:
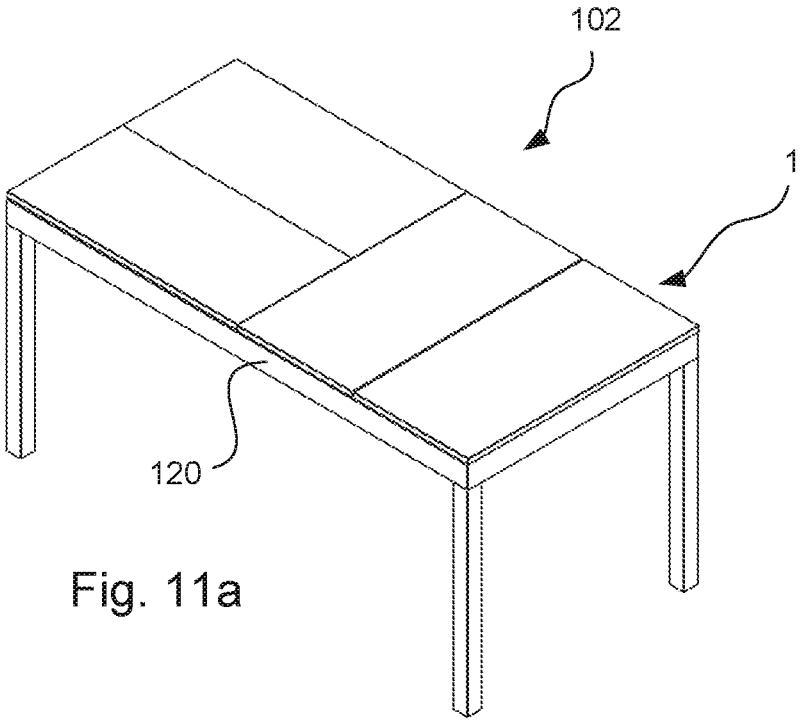
FIGS. 11*a-b* show an extendable table according to an embodiment.
Figure 11B:
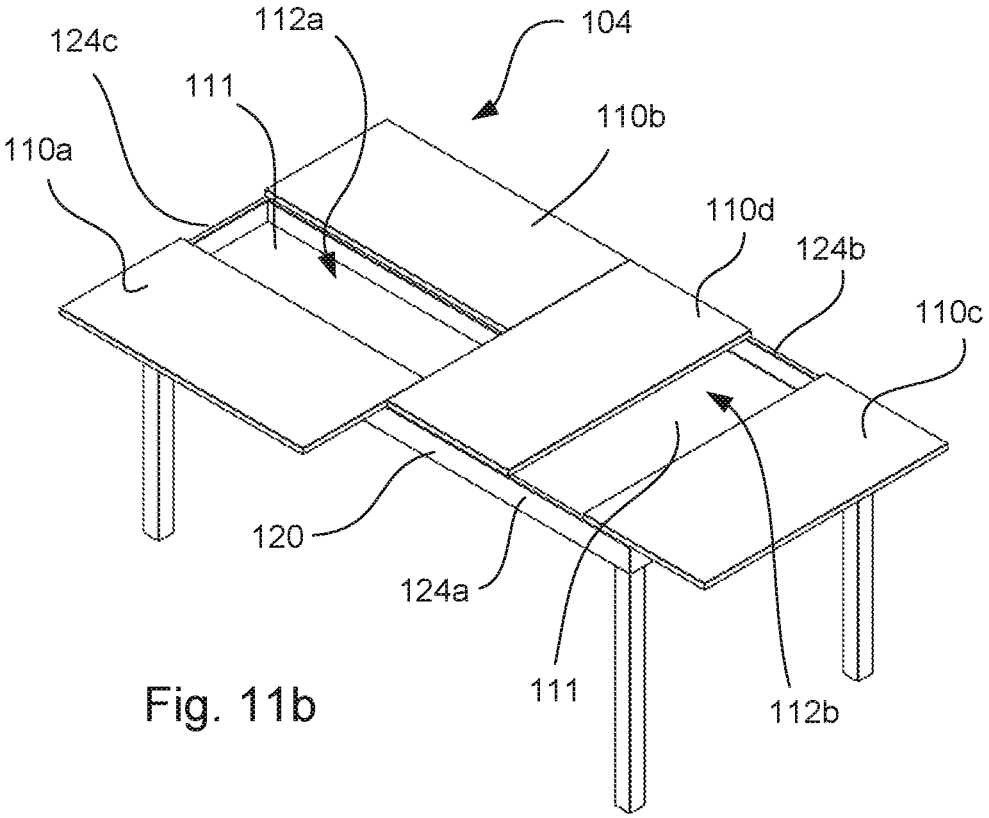

In FIGS. 11*a-b* another embodiment of an extendable table 1 is shown. The frame 120 supports four table surfaces 110*a-d*, arranged in pairs. A first pair of table surfaces 110*a-b* are covering approximately 50% of the area of the frame 120, and the table surfaces 110*a-b* are arranged in the longitudinal direction of the frame 120, such that the two table surfaces 110*a-b* are joined in that longitudinal direction. The other pair of table surfaces 110*c-d* are covering the remaining area of the frame 120 (i.e. also approximately 50%), but they are arranged in a perpendicular orientation to the first pair of table surfaces 110*a-b*. Hence, the table surfaces 110*c-d* are arranged in the transversal direction of the frame 120, such that the table surfaces 110*c-d* are joined in that transversal direction. Each of the four table surfaces 110*a-d* may slide relative to the frame 120 of the table 1 according to principles similar to those described hereinbefore with reference to FIGS. 1*a*-5*b*.

The extendable table 1 is configured to provide storage, whereby the frame 120 is provided with a bottom surface 111 in a manner similar to the embodiment of FIGS. 10*a-b*. Of each pair of table surfaces 110*a-d*, one table surface 110*a*, 110*c* is moveable relative the frame 120. An extended position 104 is shown in FIG. 11*b*, where it can be seen that extending the table 1 by moving the movable table surfaces 110*a*, 110*c* will reveal the respective cavities 112*a*, 112*b*.

The table surface 110*c* is moveable along the longitudinal edges 124*a-b* of the frame 120, while the table surface 110*a* is moveable relative the transversal edge 124*c* of the frame 120; a transversal bar (not shown) could be arranged underneath the table surface 110*d* in order to form an additional sliding interface for the table surface 110*a*, or the table surface 110*a* could also be in sliding engagement with the table surface 110*d*. Optionally also the table surfaces 110*b* and 110*d* could be moveable relative to the frame 120.

Figure 12A:
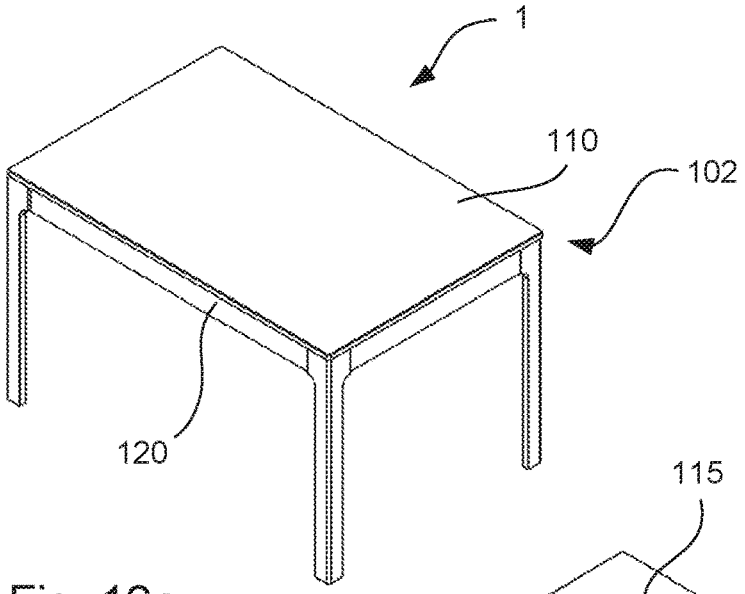
FIGS. 12*a-c* show an extendable table according to an embodiment.
Figure 12B:
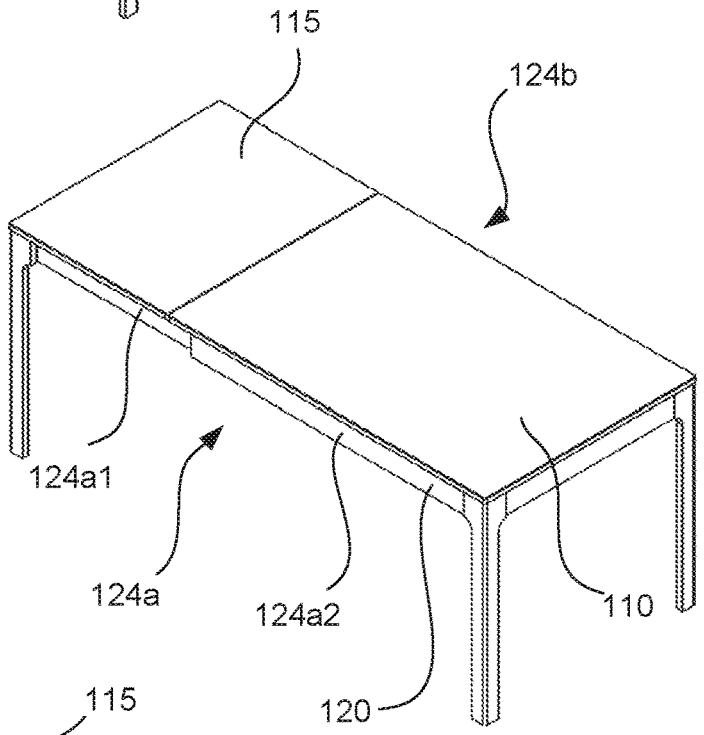
Figure 12C:
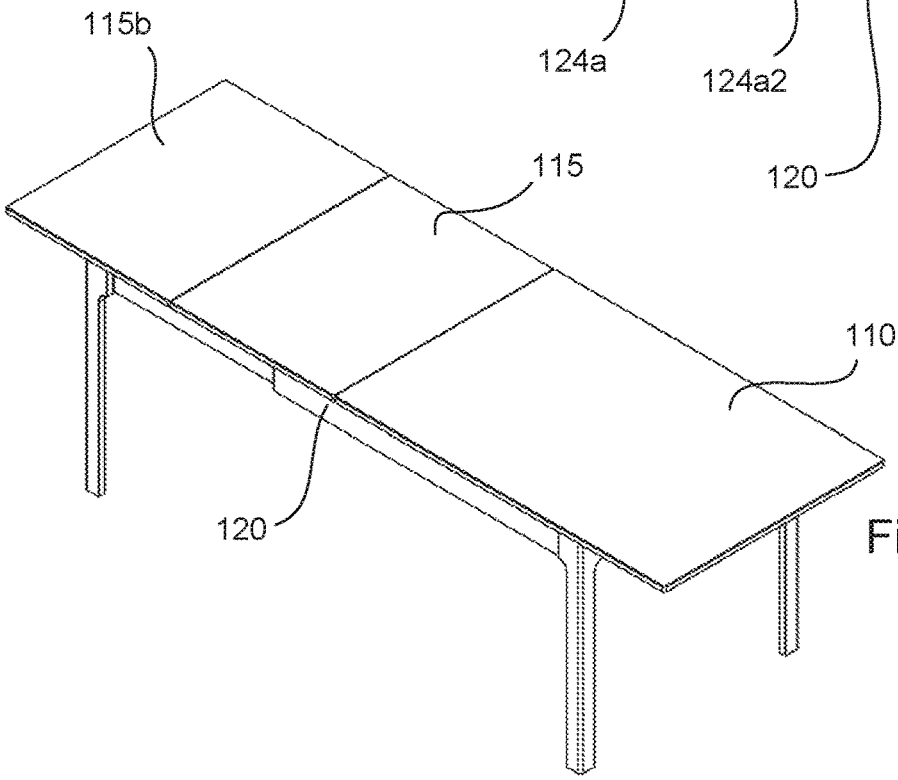

A yet further embodiment of an extendable table 1 is shown in FIGS. 12*a-c*. Contrary to the embodiments described so far, the frame 120 is in this embodiment not fixed or stationary, but instead extendable. Hence, the table 1 is extendable by i) extending the frame 120, and/or ii) moving a table surface 110 relative the frame 120 to an extended position.

In FIG. 12*a*, a table surface 110 is arranged onto a frame 120. Hence, the table 1 is in a retracted position 102. As is shown in FIG. 12*b*, the frame 120 has been extended by means of the longitudinal edges 124*a-b*, each longitudinal edge 124*a-b* being formed by two members 124*a*1, 124*a*2 being in sliding engagement with each other. Examples of such extendable configuration of a table frame 120 are described in WO2017/042203 by the same applicant, and will not be repeated herein. As the frame 120 is extended, a secondary table surface 115 may be arranged adjacent to the table surface 110 such that the entire area of the extended frame 120 is covered by the table surfaces 110, 115

In FIG. 12*c* a further extension of the table 1 is shown. Here, the table surfaces 110, 115 have been moved in relation to the extended frame 120, such that an additional secondary table surface 115*b* is allowed to be added to the table 1. The table surfaces 110, 115 are moveable relative the frame 120 by means of sliding systems described above, e.g. with reference to FIGS. 1*a*-5*b*.

Figure 13A:
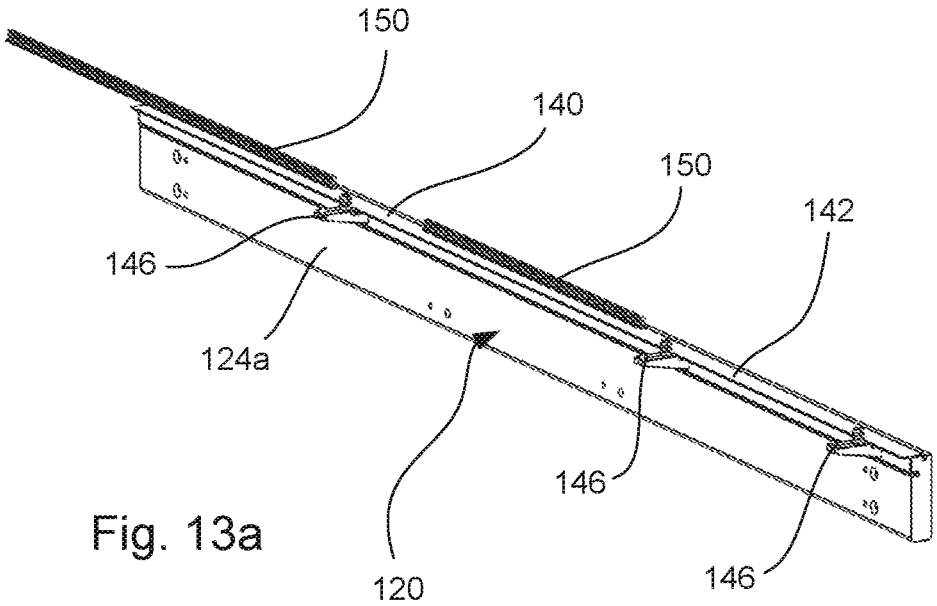
FIGS. 13*a-b* show a sliding system according to an embodiment.
Figure 13B:
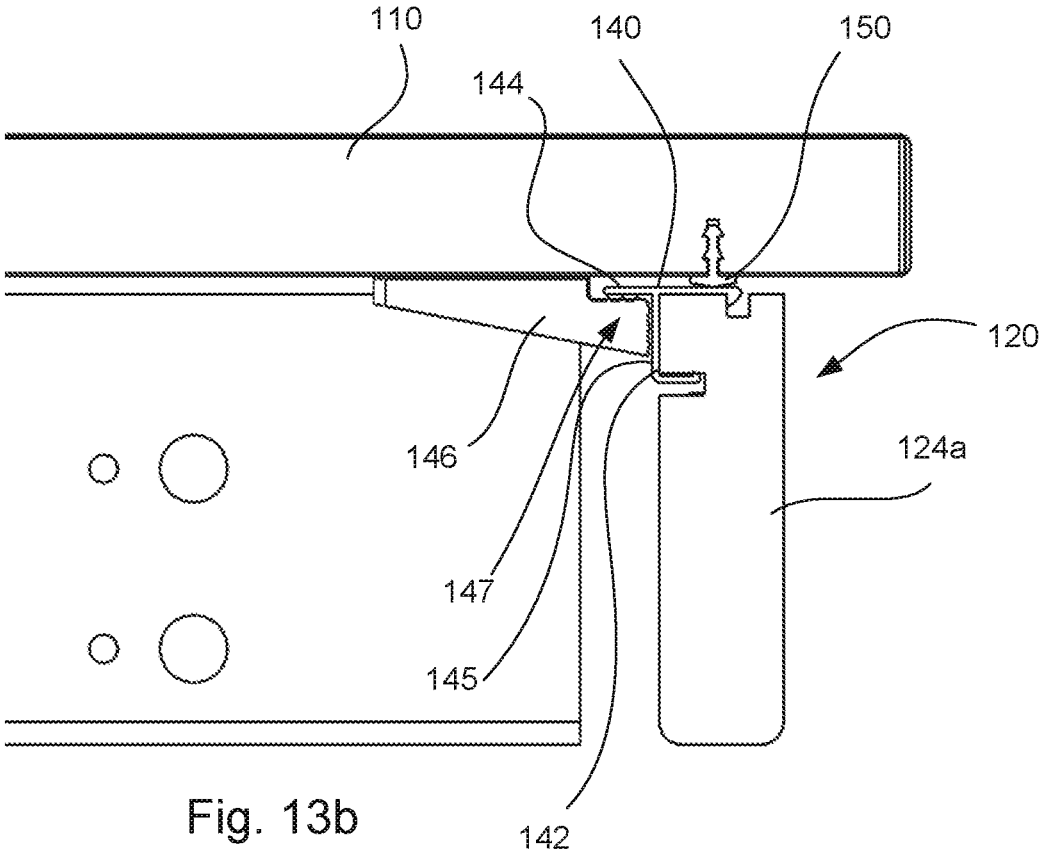

Now turning to FIGS. 13*a-b*, details of an extendable table sliding system according to an embodiment is shown. FIG. 13*a* shows a section of the sliding system, i.e. one longitudinal edge 124*a* of the frame 120; the table surface is omitted, and FIG. 13*b* shows a cross-sectional view of the sliding interface between the table surface 110 and the frame 120.

The underside of the table surface 110 is provided with one or more sliding members 150. As can be seen in FIG. 13*a*, two sliding members 150 are provided on one lateral side of the table surface 110. Each sliding member 150 is configured as a plastic plug, having a substantial longitudinal extension. For example, two sliding members 150 may have a total length being equal to, or slightly less, than the length of the table surface 110.

Each sliding member 150 is pushed into a groove of the table surface 110 in order to fixate the position of each sliding member 150. The distal end of each sliding member 150 is pointing downwards, towards the frame 120. In order to provide for the sliding interface, the frame 120 is provided with a sliding surface 140. The sliding surface 140 is preferably provided on a metal profile 142 that extends along the major part of the length of the frame 120. As shown in FIG. 13*a*, the profile 142 is arranged onto the upper part of the longitudinal edge 124*a* of the frame 120.

The profile 142 has a planar upper surface which forms the sliding surface 140. Hence, as the table surface 110 is placed onto the frame 120 the sliding member 150 will be in contact with the sliding surface 140.

The sliding surface 140 is extended by means of a lateral projection 144 which is directed inwards from the frame 120. The projection 144 forms a vertical stop member for a guiding member 146, which is also mounted to the underside of the table surface 110. In fact, there may be a plurality of guiding members 146 along the length of the table surface 110, as illustrated in FIG. 13*a*.

The guiding member 146 is preferably made of plastic, and has a sliding part 147 that engages with the projection 144, as well as with a vertical sliding surface 145 of the profile 142. Thereby the guiding member 146 guides the movement of the table surface 110 both in the vertical direction and in the horizontal direction. A sliding interface is thereby formed between the sliding member 150 and the sliding surface 140, between the guiding member 146 and the projection 144, and between the guiding member 146 and the vertical sliding surface 145. The sliding part 147 is preferably provided with protrusions or blades that reduce the contact area of the sliding part 147, as explained above.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Moreover, although the foregoing descriptions and the associated drawings describe exemplary embodiments in the context of certain exemplary combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. In cases where advantages, benefits or solutions to problems are described herein, it should be appreciated that such advantages, benefits and/or solutions may be applicable to some example embodiments, but not necessarily all example embodiments. Thus, any advantages, benefits or solutions described herein should not be thought of as being critical, required or essential to all embodiments or to that which is claimed herein. Although specific terms are employed herein, they are used in a generic and descriptive sense only and not for purposes of limitation.

The invention claimed is:

1. A table sliding system comprising:

a table surface and a frame together forming a sliding system comprising a sliding surface and at least one non-rotating sliding member;

wherein said at least one sliding member is arranged to be movable along said sliding surface, to provide a relative movement between said table surface and said frame; and wherein said sliding surface is recessed from an underside of said table surface, and said at least one sliding member projects from said frame to engage said sliding surface.

2. The table sliding system according to claim 1, wherein said table surface forming an entire table surface of an extendable table in a first, shorter, setting of said extendable table.

3. The table sliding system according to claim 1, wherein said frame is arranged to be stationary during said relative movement.

4. The table sliding system according to claim 1, wherein said at least one sliding member is arranged to be stationary during said relative movement.

5. The table sliding system according to claim 1, wherein said at least one sliding member extends horizontally, and vertically towards said sliding surface.

6. The table sliding system according to claim 1, wherein said sliding surface comprises at least one opening arranged to receive said at least one sliding member.

7. The table sliding system according to claim 1, wherein the sliding surface and the at least one sliding member are configured to only allow said relative movement along a single axis (A).

8. The table sliding system according to claim 1, wherein the sliding surface and the at least one sliding member are configured such that the relative movement moves said sliding system between a retracted position and an extended position.

9. The table sliding system according to claim 8, wherein the sliding surface and the at least one sliding member are configured to only allow said relative movement from said retracted position to said extended position along a single axis direction.

10. The table sliding system according to claim 9, comprising a plurality of sliding members, and wherein said sliding members are arranged asymmetrically in relation to a mid-point of the table sliding system, along said single axis direction.

11. The table sliding system according to claim 8, wherein said table surface and/or said frame further comprises interlocking means to keep said system in one of said positions.

12. The table sliding system according to claim 8, wherein said secondary table surface is arranged to only be accessible from said storage when said system is in said extended position.

13. The table sliding system according to claim 1, wherein said frame further comprises a secondary sliding surface, preferably the secondary sliding surface is configured to be arranged in contact with a portion associated with the sliding surface.

14. The table sliding system according to claim 13, wherein said secondary table surface is arranged to rest on said secondary sliding surface.

15. The table sliding system according to claim 1, further comprising a secondary table surface configured to be arranged in parallel to said table surface.

16. The table sliding system according to claim 15, wherein said table surface and said secondary table surface comprise aligning means to align said table surfaces with each other.

17. The table sliding system according to claim 15, wherein said secondary table surface is arranged to be stored in a storage within said frame.

18. The table sliding system according to claim 1, wherein said frame is non-extendable.

19. The table sliding system according to claim 1, wherein said sliding surface is coated with a lacquer comprising a resin, wherein said lacquer in tum is at least partly coated with a lipophilic composition coating to provide a slide layer with a lowered friction.

20. The table sliding system according to claim 1, wherein said sliding member is made of plastic.

21. The table sliding system according to claim 1, wherein said sliding surface is formed on at least one surface of a C-shaped groove in either said table surface or said frame.

22. An extendable table comprising at least one sliding system according to claim 1.

23. A table sliding system comprising:

a table surface and a frame together forming a sliding system comprising a sliding surface and at least one non-rotating sliding member;

wherein said at least one sliding member is arranged to be movable along said sliding surface, to provide a relative movement between said table surface and said frame; and wherein said sliding surface has a planar surface, and said planar surface is located on a top of said frame and faces said table surface, and said at least one sliding member projects from an underside of said table surface to engage said planar surface.

* * * * *